US007448093B1

(12) United States Patent
Rück

(10) Patent No.: US 7,448,093 B1
(45) Date of Patent: Nov. 11, 2008

(54) GAS- AND LIQUID-PROOF SAFETY SUIT

(75) Inventor: Klaus-Michael Rück, Bad Oldesloe (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 188 days.

(21) Appl. No.: 11/458,836

(22) Filed: Jul. 20, 2006

(30) Foreign Application Priority Data

Sep. 24, 2005 (DE) ..... 10 2005 045 820

(51) Int. Cl.
*A41D 13/00* (2006.01)
*A62B 17/00* (2006.01)

(52) U.S. Cl. ..... 2/457; 2/60; 2/123

(58) Field of Classification Search ..... 2/457, 2/2.5, 16, 60, 123, 162, 270, 2.17, 85, 101, 2/124, 160, 166, 170, 232, 304, 311, 312, 2/316, 317, 320, 257, 233, 231, 242, 239, 2/125, 901, 2.14, 458, 2.15, 2.11; 285/260, 285/305; 36/1

See application file for complete search history.

(56) References Cited

U.S. PATENT DOCUMENTS 2,869,138 A * 1/1959 Hankoff ..... 2/311
2,962,724 A * 12/1960 Wilkens ..... 2/232
3,411,160 A * 11/1968 Le Roux et al. ..... 2/232
7,225,470 B1 * 6/2007 Bradford ..... 2/2.11

FOREIGN PATENT DOCUMENTS

AT 135539 B * 11/1933
DE 8318764 U 11/1983

* cited by examiner

*Primary Examiner*—Gary L Welch
*Assistant Examiner*—Amber R Anderson
(74) *Attorney, Agent, or Firm*—McGlew & Tuttle, P.C.

(57) ABSTRACT

A safety suit material can be connected to a plurality of gloves or boots to provide a gas- or liquid-proof connection. A support ring (3) is provided, which is in contact with the inner side of a boot-leg (2) and has a cuff (4) that can be folded over to the outside.

20 Claims, 4 Drawing Sheets

GAS- AND LIQUID-PROOF SAFETY SUIT

CROSS REFERENCE TO RELATED APPLICATIONS

This application claims the benefit of priority under 35 U.S.C. § 119 of German Patent Application DE 10 2005 045 820.3 filed Sep. 24, 2005, the entire contents of which are incorporated herein by reference.

FIELD OF THE INVENTION

The present invention pertains to a safety suit for the gas- or liquid-proof connection of gloves or boots with arm or leg openings of the safety suit having a support ring made of a solid material.

BACKGROUND OF THE INVENTION

A safety suit of the type is known from DE 83 18 764 U. To connect a leg opening to a boot-leg, the latter is made of a solid material in the form of a support ring. The leg opening of the safety suit consists of an elastically flexible material, which can be pulled over the boot-leg. The support ring is provided at the boot-leg with a circular groove, which forms a sealing arrangement together with the leg opening. To fix the leg opening to the support ring, the material of the suit is pressed into the groove by means of a clamping strap.

The prior-art connection of the leg opening to the boot-leg is suitable only for thin, sufficiently elastic suit materials, which can be pulled tightly over the boot-leg. Only boots that have a specially prepared boot-leg can be used. Folds, which compromise the tightness of the connection site, may be formed in the area of the boot-leg in case of safety suits that consist of a solid, less flexible material.

SUMMARY OF THE INVENTION

The basic object of the present invention is to improve a safety suit such that it can be connected to a plurality of gloves or boots in a gas-proof and liquid-proof manner.

According to the invention, a safety suit is provided for the gas- or liquid-proof connection of gloves or boots with arm or leg openings of the safety suit having a support ring made of a solid material. The support ring comprises a support ring that is in contact with the inner side of the glove leg or boot-leg and has an elastic cuff. The elastic cuff can be folded over from the inner side to the outer side and presses the arm or leg opening of the safety suit against the glove leg or boot-leg.

A clamping strap may also be provided bracing the cuff against the support ring.

A projecting length L of the cuff may be formed as a length that can be folded over the clamping strap from the outside.

The cuff may advantageously consist of a thermoplastic elastomer.

The advantage of the present invention is essentially that a support ring made of a solid material is introduced, located on the inside, into the boot or glove, and a cuff connected to the support ring in one piece is laid from the inside over the suit material at the glove or at the boot. The cuff consisting of an elastic material can be laid easily on the inner side of the suit material, so that tightness is not compromised by possible fold formation.

The following procedure is followed when mounting the leg opening of a safety suit on a boot-leg. The leg opening is first pulled from below over the boot such that the inner side of the suit material faces outwardly and the leg opening ends flush with the upper edge of the boot-leg. The support ring is then inserted into the boot-leg together with the cuff and the cuff is then folded over to the outside, so that the leg opening is covered by the cuff in the area of the boot-leg. For better fixation, a tightening clamp, with which the cuff and the leg opening are pressed against the support ring together with the boot-leg, is placed on the cuff from the outside.

The length of the cuff is selected to be such that it has a projection of the length L from the clamping strap. This projection is pulled over the clamping strap, so that the clamping strap is covered by the cuff and the suit material lying on the clamping strap in the use position is protected from mechanical damage. The cuff advantageously consists of a soft, elastic material, preferably a thermoplastic elastomer.

An exemplary embodiment is shown in the figure and will be explained in greater detail below. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
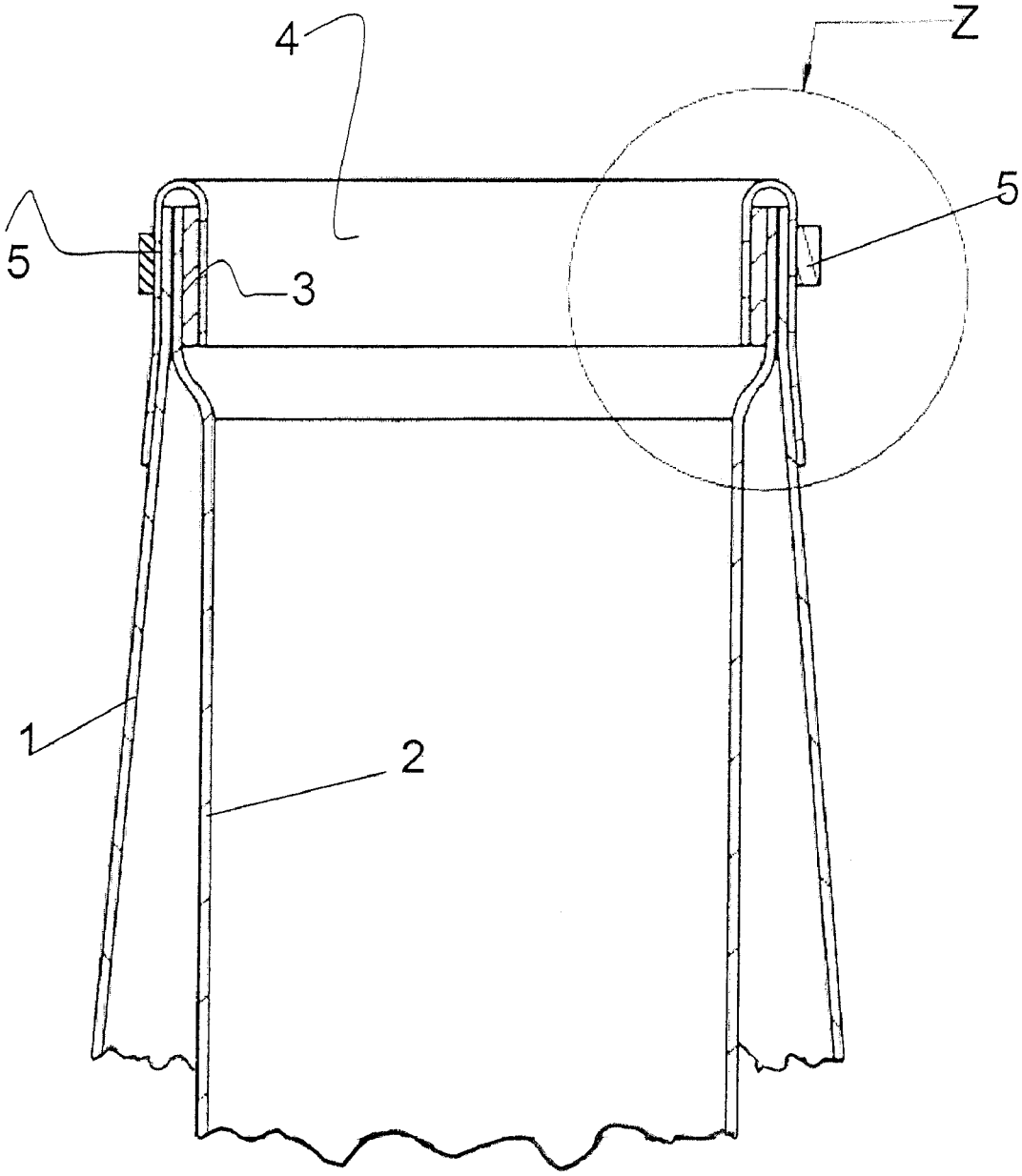
FIG. 1 is a longitudinal sectional view of a safety suit in the area of a leg opening.

Referring to the drawings in particular, FIG. 1 shows the longitudinal section of a leg opening (leg opening material) 1 at a boot-leg 2 of a safety suit, not shown in greater detail (the suit is cut away and not shown beyond leg opening material 1). A support ring 3 is in contact with the inner side of the boot-leg 2. The support ring 3 has a cuff 4 made of an elastic material, which is turned over the ring 3 to the outside. The cuff material 4 lies on the leg opening suit material (the leg opening material 1). The leg opening material 1 is braced against the support ring 3 together with the boot-leg 2 with a clamping strap 5, which lies on the part of the cuff material 4 that is turned over to the outside.

Figure 2:
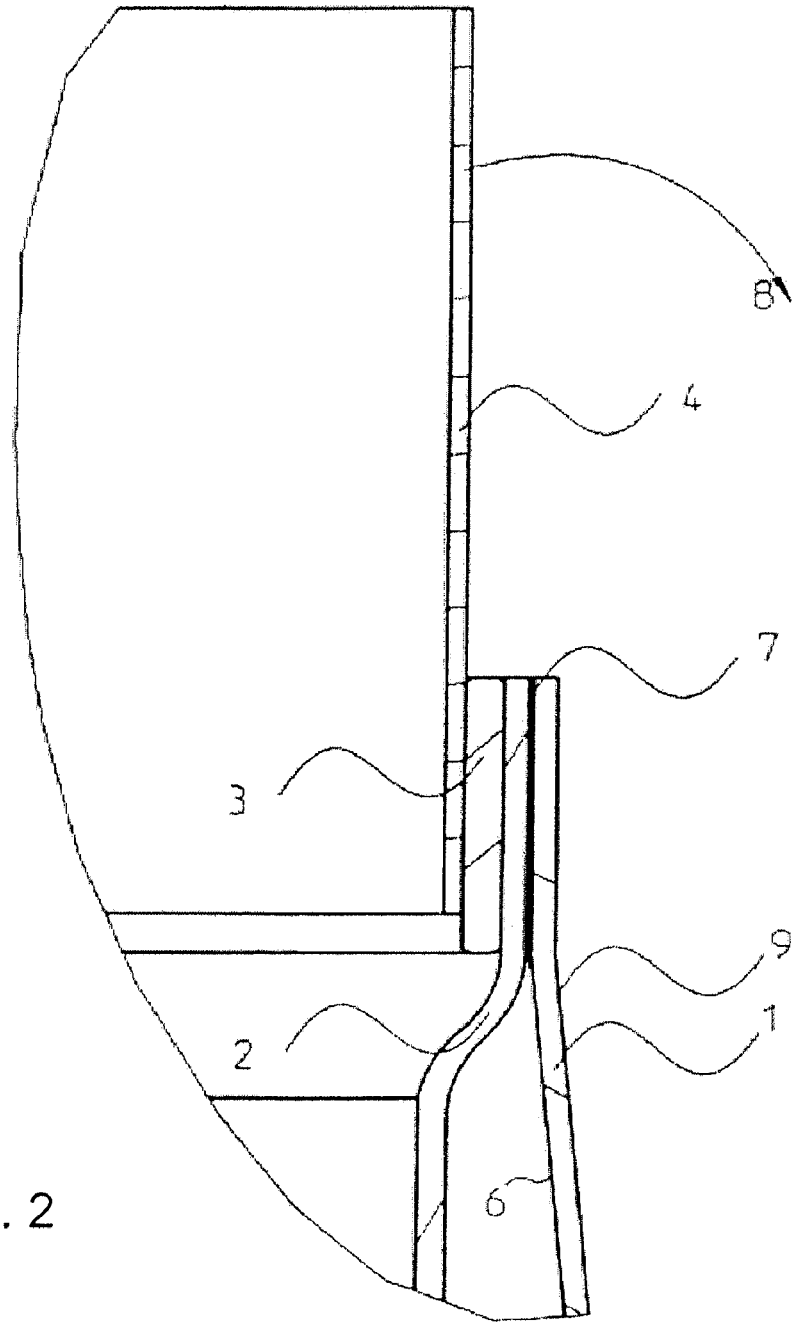
FIG. 2 is a sectional view showing a detail Z according to FIG. 1 in the assembled state.

FIG. 2 illustrates detail Z according to FIG. 1 in the assembled state, when the connection between the boot-leg 2 and the leg opening material 1 is established. The leg opening material 1 is shown turned up toward the inside and pulled from the top over the boot-leg 2. The outer side 6 of the suit material is now in contact with the boot-leg 2. Possible unevennesses of the boot-leg 2 can be compensated by an elastomer ring 7 pulled in advance over the boot-leg 2. The support ring 3 is then inserted into the boot-leg 2 together with the cuff 4, so that it is in contact with the inner side. The cuff 4, which consists of a thermoplastic elastomer, is turned out—toward the outside along arrow 8, so that it is in contact with the inner side 9 of the suit material.

Figure 3:
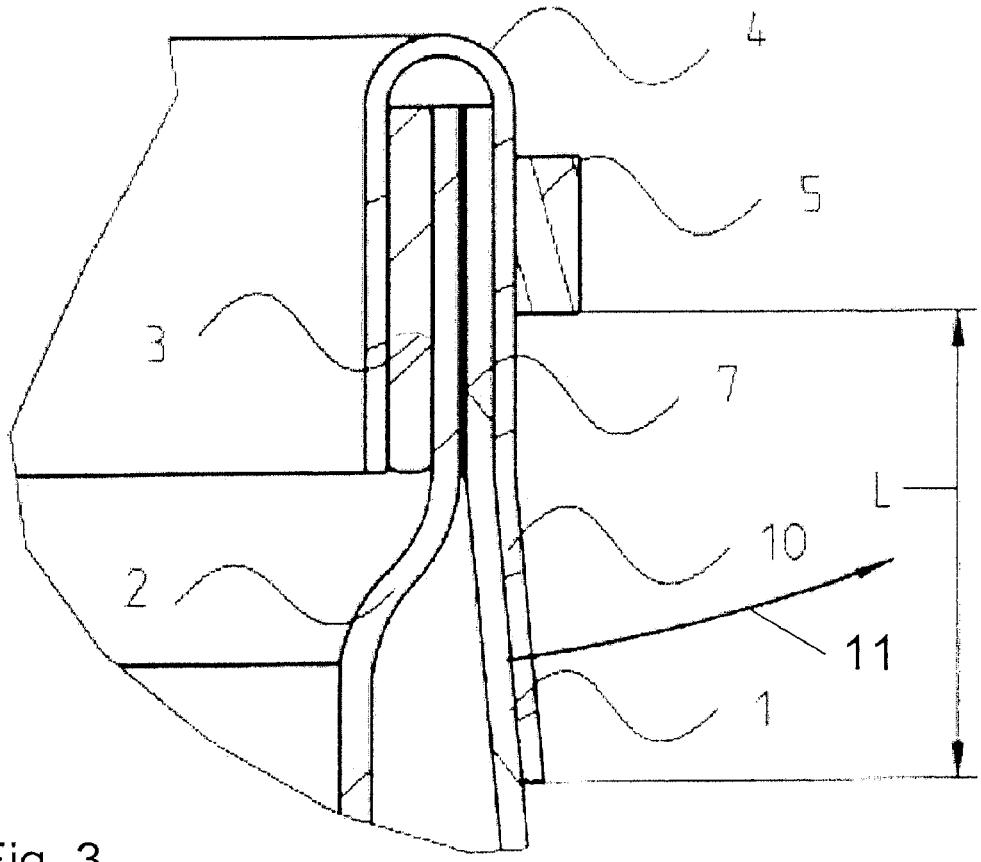
FIG. 3 is a sectional view showing detail Z according to FIG. 2 with the cuff turned up.

FIG. 3 illustrates detail Z according to FIG. 2 with the cuff 4 turned out. The cuff 4 is braced with the clamping strap 5 against the support ring 3 together with the leg opening material 1 and the boot-leg 2.

The cuff 4 has a projection 10 of the length L in relation to the clamping strap 5. When the boot-leg 2 is brought into the use position by turning up the leg opening material 1 along arrow 11 and pulling it upward, the projection 10 lies on the clamping strap 5 and thus protects the suit material in the use position from being damaged by the clamping strap 5.

Figure 4:
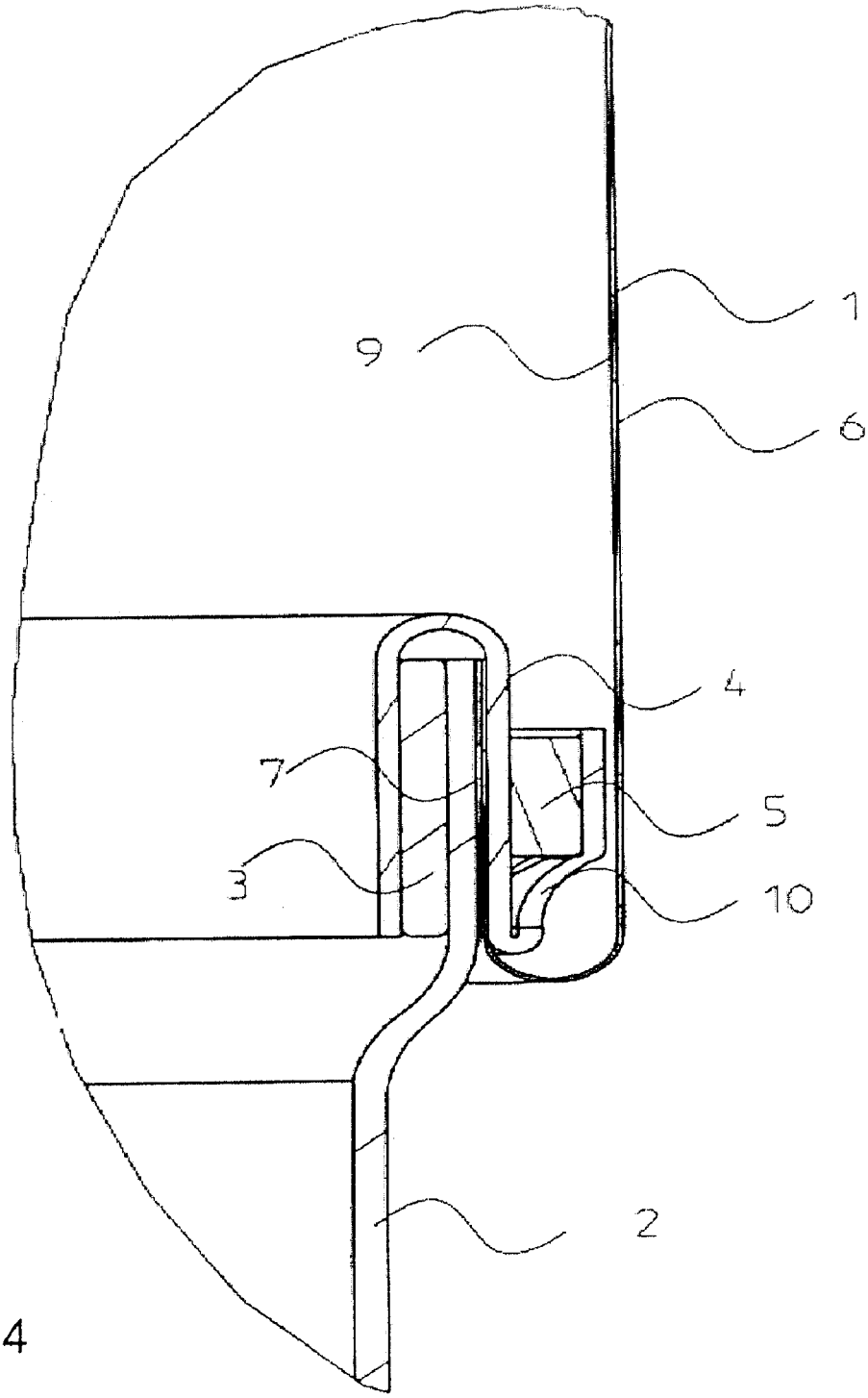
FIG. 4 is a sectional view showing detail Z according to FIG. 3 in the use position.

The use position of the safety suit in the area of the leg opening 1 is illustrated in FIG. 4. The leg opening material 1 is pulled upward up to the clamping strap 5, so that the outer side 6 of the leg opening 1 extends flush with the outer side of the boot-leg 2.

While specific embodiments of the invention have been shown and described in detail to illustrate the application of the principles of the invention, it will be understood that the invention may be embodied otherwise without departing from such principles.

What is claimed is:

1. A safety suit for the gas- or liquid-proof connection of gloves or boots with arm or leg openings, the safety suit comprising:

safety suit arm or leg opening material having an outer surface and an inner surface;

a glove leg or boot-leg material having a glove leg or boot-leg outer surface;

a support ring having a support ring inner surface and a support ring outer surface, said support ring outer surface being in contact with an inner side of said glove leg or boot-leg;

an elastic cuff connected to said support ring inner surface, said elastic cuff being moveable from a non-use position to a use position, said cuff forming a first folded portion and a second folded portion in said use position to press said safety suit arm or leg opening material against said glove leg or boot-leg, wherein said first folded portion seals at least a portion of said safety suit arm or leg opening material, said glove leg or boot-leg material and said support ring, and said second folded portion is folded in a direction opposite of said first folded portion such that said second folded portion is located at a spaced location from said first folded portion, said elastic cuff being in contact with said inner surface of said safety suit arm or leg opening material in said non-use position, said outer surface of said safety suit arm or leg opening material extending substantially parallel to said to said boot-leg outer surface.

2. A safety suit in accordance with claim 1, further comprising a clamping strap bracing said elastic cuff against said support ring.

3. A safety suit in accordance with claim 2, wherein said second folded portion comprises a projecting length L of the cuff formed as a length that encloses said clamping strap from outside said clamping strap.

4. A safety suit in accordance with claim 2, wherein said clamping strap has an inner clamping strap surface and an outer clamping strap surface, said elastic cuff being in contact with said inner clamping strap surface and said outer clamping strap surface in said use position.

5. A safety suit in accordance with claim 2, wherein said first folded portion of said elastic cuff bridges said support ring, said glove leg or boot-leg and said safety suit arm or leg opening material.

6. A safety suit in accordance with claim 1, wherein said elastic cuff consists of a thermoplastic elastomer.

7. A safety suit in accordance with claim 1, wherein said glove leg or boot-leg material has an upper glove leg or boot-leg material upper portion, said safety suit arm or leg opening material having a safety suit arm or leg opening material upper portion, said glove leg or boot-leg material upper portion being adjacent to said safety suit arm or leg opening material upper portion, said cuff engaging said safety suit arm or leg opening material upper portion.

8. A safety suit in accordance with claim 7, further comprising an elastomer ring having an outer elastomer ring surface and an inner elastomer ring surface, said outer elastomer ring surface extending between said glove leg or boot-leg material and said safety suit arm or leg opening material such that said outer elastomer ring surface is in contact with said safety suit arm or leg opening material upper portion and said inner elastomer ring surface is in contact with said upper glove leg or boot-leg material upper portion.

9. A safety suit with a gas- or liquid-proof glove or boot connection, the safety suit comprising:

glove leg or boot-leg material having an outer surface, said glove leg or boot-leg having a glove leg or boot-leg material upper portion;

safety suit arm or leg opening material having a safety suit arm or leg opening material upper portion, said glove leg or boot-leg material upper portion being adjacent to said safety suit arm or leg opening material upper portion, said safety suit arm or leg opening material having a safety suit arm or leg opening material inner surface;

a support ring disposed in contact with an inner side of said glove leg or boot-leg material; and a cuff connected to said support ring and extending out of said glove leg or boot-leg material, said cuff being moveable from a non-use position to a use position, said cuff engaging said safety suit arm or leg opening material inner surface in said non-use position, said cuff forming a first folded portion and a second folded portion in said use position such that said first folded portion and said second folded portion press said safety suit arm or leg opening material against said glove leg or boot-leg wherein said first folded portion seals at least a portion of said safety suit arm or leg opening material, said glove leg or boot-leg material and said support ring, and said second folded portion is folded in a direction opposite of said first folded portion such that said second folded portion is located at a spaced location from said first folded portion.

10. A safety suit in accordance with claim 9, further comprising a clamping strap bracing said cuff against said support ring.

11. A safety suit in accordance with claim 10, wherein said second folded portion comprises a projecting length L of the cuff formed as a length that encloses said clamping strap such that said cuff engages an outer surface of said clamping strap.

12. A safety suit in accordance with claim 10, wherein said clamping strap has an outer side surface, said cuff engaging said outer side surface of said clamping strap when said cuff is in said use position, said safety suit arm or leg opening having an outer surface, said outer surface being substantially parallel to said outer surface of said glove leg or boot-leg material.

13. A safety suit in accordance with claim 12, wherein said clamping strap has an inner side surface in contact with a portion of said elastic cuff.

14. A safety suit in accordance with claim 9, wherein the cuff consists of a thermoplastic elastomer.

15. A method of providing a safety suit with a gas- or liquid-proof glove or boot connection, the safety suit method comprising:

providing glove leg or boot-leg material having an outer glove leg or boot-leg side;

providing safety suit arm or leg opening material for connection with said glove or boot leg material, said safety suit arm or leg opening material having an outer side;

providing a support ring;

providing a cuff connected to said support ring;

pulling the safety suit arm or leg opening material over the glove or boot leg material to define a non-use position such that an inner side of the safety suit arm or leg opening material faces outwardly and the leg opening material is at or adjacent to the upper edge of the glove or boot-leg material;

inserting the support ring into the glove or boot-leg material together with the cuff;

folding the cuff over to the outside of the glove or boot-leg material to provide a first folded portion such that the inner side of said safety suit arm or leg opening material is in contact with said cuff;

folding the cuff to provide a second folded portion, said second folded portion being located at a spaced location from said first folded portion and disposed opposite of said first folded portion;

pulling said safety suit arm or leg opening material in a substantially upward direction to a use position such that said outer side of said safety suit arm or leg opening material extends substantially parallel to said outer glove leg or boot-leg material side.

16. A method according to claim 15, further comprising:

providing a tightening clamp; and pressing the cuff, the leg opening material together with the glove or boot-leg material against the support ring.

17. A safety suit in accordance with claim 16, wherein said cuff forms a first folded portion bridging said support ring, said glove leg or boot-leg and said safety suit arm or leg opening material, said cuff forming a second folded portion, said tightening clamp having an inner clamp surface and an outer clamp surface, said cuff engaging said inner clamp surface and said outer clamp surface.

18. A method according to claim 15, wherein the cuff consists of a thermoplastic elastomer.

19. A method according to claim 15, wherein said glove leg or boot-leg material has an upper glove leg or boot-leg material upper portion, said safety suit arm or leg opening material having a safety suit arm or leg opening material upper portion, said glove leg or boot-leg material upper portion being adjacent to said safety suit arm or leg opening material upper portion, said cuff engaging said safety suit arm or leg opening material upper portion.

20. A method in accordance with claim 19, further comprising the step of providing an elastomer ring having an outer elastomer ring surface and an inner elastomer ring surface, said outer elastomer ring surface extending between said glove leg or boot-leg material and said safety suit arm or leg opening material such that said outer elastomer ring surface is in contact with said safety suit arm or leg opening material upper portion and said inner elastomer ring surface is in contact with said upper glove leg or boot-leg material upper portion.

* * * * *